US005298039A

United States Patent [19]

Mohr et al.

[11] Patent Number: 5,298,039

[45] Date of Patent: Mar. 29, 1994

[54] FUELS FOR GASOLINE ENGINES

[75] Inventors: Juergen Mohr, Gruenstadt; Knut Oppenlaender, Ludwigshafen; Juergen Thomas, Fussgoenheim; Peter Schreyer, Weinheim, all of Fed. Rep. of Germany

[73] Assignee: BASF Aktiengesellschaft, Ludwigshafen, Fed. Rep. of Germany

[21] Appl. No.: 993,054

[22] Filed: Dec. 18, 1992

[30] Foreign Application Priority Data

Dec. 20, 1991 [DE] Fed. Rep. of Germany ..... 4142241

[51] Int. Cl.[5] ..... C10L 1/18; C10L 1/22

[52] U.S. Cl. ..... 44/443; 44/412; 44/436

[58] Field of Search ..... 44/443, 436, 447, 412

[56] References Cited

U.S. PATENT DOCUMENTS

| | | | |
|---|---|---|---|
| 2,786,745 | 3/1957 | Stayner et al. | 44/443 |
| 3,020,137 | 2/1962 | Condo | 44/440 |
| 3,615,295 | 1/1971 | Manary | 44/443 |
| 4,235,712 | 11/1980 | McClaflin | 210/708 |
| 4,445,908 | 5/1984 | Compere et al. | 44/443 |
| 4,549,884 | 10/1985 | Mourao | 44/443 |
| 4,859,210 | 8/1989 | Franz et al. | 44/443 |
| 4,877,416 | 10/1989 | Campbell | 44/443 |
| 5,004,478 | 4/1991 | Vogel et al. | 44/443 |
| 5,112,364 | 5/1992 | Rath et al. | 44/418 |
| 5,145,948 | 9/1992 | Oppenlaender et al. | 252/52 A |

FOREIGN PATENT DOCUMENTS

| | | |
|---|---|---|
| 550252 | 12/1957 | Canada . |
| 637437 | 2/1962 | Canada . |
| 0356725 | 3/1990 | European Pat. Off. . |
| 1102477 | 3/1961 | Fed. Rep. of Germany . |
| 1243207 | 12/1959 | France . |

OTHER PUBLICATIONS

Additive fur Kraftstoffe, Rossenbeck, pp. 223 et seq. Stuttgart 1978.

*Primary Examiner*—Prince Willis, Jr.
*Assistant Examiner*—J. Silbermann
*Attorney, Agent, or Firm*—Keil & Weinkauf

[57] ABSTRACT

Fuels for gasoline engines contain a combination of a nitrogen-containing detergent component and an alkoxylate as a carrier oil component, the alkoxylate being a dialkylphenol-initiated propoxylate.

5 Claims, No Drawings

FUELS FOR GASOLINE ENGINES

The present invention relates to fuels for gasoline engines which contain small amounts of a combination of a nitrogen-containing detergent component and a carrier oil component, the latter comprising dialkylphenol-initiated propoxylates.

The carburetor and intake system of gasoline engines as well as injection systems for metering fuel in gasoline and diesel engines are being increasingly contaminated by impurities which are caused by dust particles from the air, by uncombusted hydrocarbon residues from the combustion chamber and by the crankshaft casing vent gases passed into the carburetor.

These residues change the air/fuel ratio during idling and in the lower part-load range so that the mixture becomes richer, the combustion more incomplete and in turn the amounts of uncombusted or partly combusted hydrocarbons in the exhaust gas become larger and the gasoline consumption increases.

It is known that, in order to avoid these disadvantages, fuel additives are used for keeping valves and carburetor or injection systems clean (cf. for example M. Rossenbeck in Katalysatoren, Tenside, Mineralöladditive, Editors J. Falbe, U. Hasserodt, page 223 et seq., G. Thieme Verlag, Stuttgart 1978).

Depending on the mode of action, as well as on the preferred place of action of such detergent additives, a distinction is now made between two generations.

The first generation of additives was capable of preventing only the formation of deposits in the intake system but not of removing deposits which were already present, whereas the modern additives of the second generation can do both (keep-clean and clean-up effect), this being so because of different thermal properties, in particular in zones at relatively high temperatures, i.e. in the intake valves.

The question of the increase in the octane number requirement of gasoline engines due to deposition in the combustion chamber over a certain time and the possibility of intervening advantageously here by introducing specific additives in the fuel are attracting increasing attention in the development of novel additives.

By skillful combination of such detergents which keep the intake system clean with further components, it is possible to achieve a broader action spectrum of such formulations.

The carrier oils in particular have a central role here.

Thus, on the one hand, it is possible to increase the efficiency of the detergents in the carburetor or intake system using special, generally synthetic carrier oil components, owing to synergistic effects. Certain additives display this action only in combination with an oil.

On the other hand, by adding carrier oils it is possible to have an advantageous effect on parts of the engine which are usually not reached by the conventional additives acting predominantly in the intake system.

The combustion chamber deposits (ORI problem) discussed above may be mentioned in particular in this context.

U.S. Pat. No. 4,877,416 discloses fuel mixtures which contain a carrier oil in addition to an amine as a detergent component. Examples of carrier oils are poly(oxyalkylene)monools having terminal hydrocarbon groups. Examples of terminal hydrocarbon groups are a large number of possible radicals, including in particular $C_7$–$C_{30}$-alkylphenyl. By way of example, a carrier oil which was obtained by butoxylation of dodecylphenol is described.

In addition to the effects with regard to keeping valves and intake systems clean and preventing deposits in the combustion chamber, the compatibility between the additives must however also be taken into account in choosing the additives. Thus, if they are present in a concentrate, the detergents and carrier oils must not lead to deposits or phase separation. According to U.S. Pat. No. 4,877,416, this is achieved in the case of the alkylphenol-initiated carrier oils, for example, by using butylene oxide as the alkylene oxide, although butylene oxide is relatively expensive to prepare and to use.

It is an object of the present invention to provide combinations of additives for fuels which, on the one hand, display a synergistic effect with regard to keeping the intake system clean in gasoline engines and on the other hand minimize, or even prevent, the increase in the octane number requirement of an engine, and which are highly compatible with one another in concentrated solution, i.e. do not separate. The additives should furthermore be capable of being prepared from very readily available substances and should be thermally stable.

We have found that this object is achieved by fuels for gasoline engines containing a combination of a) from 10 to 5,000 ppm of a nitrogen-containing detergent component and b) from 10 to 5,000 ppm of an alkoxylate of the following formula I

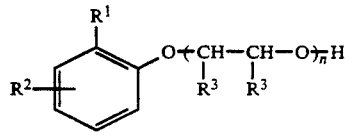

I where $R^1$ and $R^2$ independently of one another are each branched or straight-chain $C_6$–$C_{30}$-alkyl, one of the two radicals $R^3$ is methyl and the other is hydrogen and n is from 1 to 100.

We have found surprisingly that, although no butylene oxide is used for their preparation, the novel alkoxylates have good compatibility with the nitrogen-containing detergent component and furthermore prevent the stated deposits in the intake system and in the combustion chamber.

A particular advantage has been found to be the fact that the novel alkoxylates of the formula I ensure compatibility with the detergent even when a monoalkyl-substituted propoxylate is present as an additional constituent of the carrier oil component, although this propoxylate as such is not directly compatible with the nitrogen-containing detergent component.

The carrier oil component may therefore also comprise from 10 to 5,000 ppm (based on the fuel) of a monoalkylphenol-initiated propoxylate in addition to component b), this propoxylate having the structure shown in formula I, with the proviso that $R^1$ is omitted, and in particular the amount of the monoalkylphenol-initiated propoxylate is not greater than the amount of the dialkylphenol-initiated propoxylate of the formula I.

It is also possible to add other carrier oil components to the novel additive combination, for example esters of monocarboxylic acids or polycarboxylic acids and alkanols or polyols, as described in DE 38 38 918 Al.

Preferably used alkoxylates are compounds in which $R^1$ and/or $R^2$ are branched or straight-chain $C_7$–$C_{18}$-alkyl and n is from 5 to 50, in particular from 7 to 30.

The fuels preferably contain from 20 to 2,000 ppm, in particular from 50 to 1,000 ppm (all ppm data are based on weight) of the detergent component a) and of the alkoxylate b).

The nitrogen-containing detergent component used in the mixture with the novel carrier oils can in principle be any known product from among the products suitable for this purpose, as described, for example, in J. Falbe, U. Hasserodt, Katalysatoren, Tenside und Mineralöladditive, G. Thieme Verlag, Stuttgart 1978, page 221 et seq. or in K. Owen, Gasoline and Diesel Fuel Additives, John Wiley & Sons 1989, page 23 et seq.

Compounds having an amino, amido or imido group, in particular polyisobutylamines according to European Patent 0,244,616, (U.S. Pat. No. 4,832,702) ethylenediaminetetraacetamides and/or -imides according to European Patent 0,188,786 or polyetheramines according to European Patent 0,356,725, (U.S. Pat. No. 5,112,364) are preferably used, reference herewith being made to the definitions in these publications.

Mixtures of such detergents can also be used.

Amides or imides of polyisobutylenesuccinic anhydride, polybutenepolyamines and long-chain carboxamides and -imides are suitable as further detergents or additional dispersants.

The preparation of the alkoxylates is generally known and is described in, for example, EP 376 236 A1.

The dialkylphenols used as initiators are prepared in a conventional manner by Friedel-Crafts alkylation of phenols with the corresponding olefins or olefin mixtures.

The novel propoxylates have excellent compatibility particularly with the abovementioned polyisobutylamines in the particular formulations.

They support their action as intake system cleaners, including reducing the amount of detergent required.

Leaded and in particular unleaded regular and premium grade gasoline are suitable fuels for gasoline engines. The gasolines may also contain components other than hydrocarbons, for example alcohols, for example methanol, ethanol, or tert-butanol, and ethers, e.g. methyl tert-butyl ether. In addition to the alkoxylated polyetheramines to be used according to the invention, the fuels generally also contain further additives, such as corrosion inhibitors, stabilizers, antioxidants and/or further detergents.

Corrosion inhibitors are generally ammonium salts of organic carboxylic acids which, owing to an appropriate structure of the starting compounds, tend to form films. Amines for reducing the pH ar also frequently present in corrosion inhibitors. Heterocyclic aromatics are generally used for preventing nonferrous metal corrosion.

Particular examples of antioxidants or stabilizers are amines, such as para-phenylenediamine, dicyclohexylamine, morpholine or derivatives of these amines Phenolic antioxidants, such as 2,4-di-tert-butylphenol or 3,5-di-tert-butyl-4-hydroxyphenylpropionic acid and derivatives thereof, are also added to fuels and lubricants.

The results of thermogravimetric analyses are used by various authors (cf. for example U.S. Pat. No. 4,877,416) as a measure for the efficiency with regard to combustion chamber deposits, since there is as yet no general engine test for this purpose.

On the one hand, thermogravimetric analyses provide information about the thermal load capacity of a sample, for example under conditions of thermal oxidation. On the other hand, they permit conclusions to be drawn about the formation of deposits or residual amounts after such a thermal oxidation treatment. Experience has shown that the high thermal load capacity in conjunction with very little or no residue formation is advantageous with regard to the use as a carrier oil for the purposes of the present invention.

The novel alkoxylates of relatively long-chain dialkylphenols meet all these requirements (synergistic effect with detergents, demonstrated in the engine test; excellent thermal oxidation properties, demonstrated by thermogravimetric analysis) to a high degree.

The additive combination of nitrogen-containing detergent component and alkoxylate as a carrier oil component is preferably provided as a concentrate containing from 10 to 80, in particular from 30 to 60, % by weight of the detergent component and from 5 to 70, in particular from 20 to 60, % by weight of the carrier oil component, i.e. of the propoxylate. As the remainder to 100% by weight, the concentrate contains a suitable solvent, for example aromatic and/or aliphatic hydrocarbons, in particular heavy naphtha (Solvesso ®).

Testing of the products for their suitability as fuel additives is carried out by means of an engine test: The action as a valve cleaner is tested according to CEC-F-02-T-79.

EXAMPLES

Preparation of a Novel Alkoxylate 300 parts by weight of a mixture of 55% by weight of dinonylphenol and 45% by weight of nonylphenol are initially taken with 0.8 part by weight of potassium tert-butylate in an autoclave and are reacted with 620 parts by weight of propylene oxide at from 120° to 125° C. After the end of the reaction, the propoxylate thus obtained is treated with magnesium silicate until the potassium content is below 1 ppm.

Results of the engine test
Tests as intake system and valve cleaner

| Product | Deposits [mg]* for valve No. 1 | 2 | 3 | 4 |
|---|---|---|---|---|
| Basic value without additives | 417 | 289 | 176 | 660 |
| 200 ppm polyisobutylamine[1] + 200 ppm mineral oil[3]. | 70 | 83 | 135 | 121 |
| 200 ppm polyisobutylamine + 200 ppm polyether[2]. | 0 | 92 | 16 | 216 |
| 200 ppm polyisobutylamine[1] + 200 ppm novel alkoxylate according to above Example | 0 | 0 | 0 | 0 |

*According to CEC-F-02-T-79
[1]According to German Laid-Open Application DOS 3,611,230
[2]Relatively long-chain alcohol butoxylate according to U.S. Pat. No. 5,004,478
[3]SN 500

Miscibility of the alkoxylates with polyisobutylamine

Mixtures of the alkoxylates with polyisobutylamine in a volume ratio or 1:1 were prepared and the miscibility was tested. The results are shown in the Table below.

| | clear | turbid | immiscible (2 phases) |
|---|---|---|---|
| Isononylphenyl butoxylate (24 BO) | X | | |
| Isononylphenyl propoxylate (24 PO) | | | X |
| Isononylphenyl propoxylate (10 PO) | | X | |
| Diisononylphenyl propoxylate (10 PO) | X | | |

We claim:

1. A composition comprising an internal combustion fuel and a combination of a) from 10 to 5,000 ppm of a nitrogen-containing detergent component which is or contains a polyisobutylamine and b) from 10 to 5,000 ppm of an alkoxylate of the following formula I

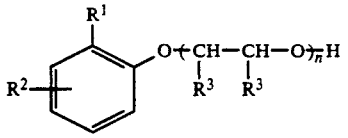

I where $R^1$ and $R^2$ independently of one another are each branched or straight-chain $C_6$–$C_{30}$-alkyl, one of the to radicals $R^3$ is methyl and the other is hydrogen and n is from 1 to 100.

2. A composition as claimed in claim 1, wherein $R^1$ or $R^2$ is branched or straight-chain $C_7$–$C_{18}$-alkyl.

3. A composition as claimed in claim 1, wherein n is from 5 to 50.

4. A composition as defined in claim 1, wherein n is from 7 to 30.

5. A concentrate of components a) and b) as defined in claim 1 in a solvent, containing from 10 to 80% by weight of the nitrogen-containing detergent component a) and from 5 to 70% by weight of the alkoxylate b) of the formula I and an amount of solvent required as the remainder to 100% by weight.

* * * * *

UNITED STATES PATENT AND TRADEMARK OFFICE

CERTIFICATE OF CORRECTION

PATENT NO. : 5,298,039
DATED : March 29, 1994
INVENTOR(S) : MOHR et al.

It is certified that error appears in the above-indentified patent and that said Letters Patent is hereby corrected as shown below:

Claim 1, column 6, line 11, delete "to" and substitute --two--.

Signed and Sealed this

Ninth Day of August, 1994

Bruce Lehman

*Attest:*

BRUCE LEHMAN

*Attesting Officer*

*Commissioner of Patents and Trademarks*